US006244445B1

(12) United States Patent
Yokoyama et al.

(10) Patent No.: US 6,244,445 B1
(45) Date of Patent: Jun. 12, 2001

(54) MOISTURIZING EQUIPMENT

(75) Inventors: Sadahiko Yokoyama; Masao Shimoda; Tokukazu Kiji, all of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/577,591

(22) Filed: May 25, 2000

(30) Foreign Application Priority Data

May 27, 1999 (JP) ..... 11-148597

(51) Int. Cl.[7] ..... B03B 1/00

(52) U.S. Cl. ..... 209/3; 209/680; 209/683; 209/687; 209/689; 209/690

(58) Field of Search ..... 209/3, 3.1, 659, 209/680, 683, 687, 689, 690

(56) References Cited

U.S. PATENT DOCUMENTS

| | | | | |
|---|---|---|---|---|
| 4,018,675 | * | 4/1977 | Petrucci | 209/86 |
| 4,191,199 | * | 3/1980 | Sullivan | 131/96 |
| 4,258,851 | * | 3/1981 | Lion et al. | 209/700 |
| 5,163,627 | | 11/1992 | Bouche . | |

FOREIGN PATENT DOCUMENTS

| | | | | |
|---|---|---|---|---|
| 69014554 | | 6/1995 | (DE) . | |
| 441611 C1 | | 11/1995 | (DE) . | |
| 69228431 | | 7/1999 | (DE) . | |
| 1.192.856 | * | 3/1958 | (FR) . | |
| WO 93/23167 | * | 11/1993 | (WO) | B02C/19/12 |

* cited by examiner

*Primary Examiner*—Donald P. Walsh
*Assistant Examiner*—Mark J. Beauchaine
(74) *Attorney, Agent, or Firm*—Young & Thompson

(57) ABSTRACT

A hollow rotating drum 1 is provided in an oblique manner and is rotated by two pairs of rollers 3*a*, 3*b*. A size classification unit 2 is provided in the vicinity of a center of the rotating drum in a lengthwise direction of the drum, and water is added from a water addition unit 4. An object to be moisturized is supplied from an opening on an upper portion of the rotating drum in a supplying direction 5 of the object. Then, the object is moved spirally within the rotating drum to be moisturized. An object, i.e., a moisture-processed substance having a size equal to or smaller than the predetermined size is classified by the size classification unit to be continuously discharged in a direction 6 of movements of the moisture-processed substance. Also, an object, i.e., residue having a larger size than the predetermined size, is continuously discharged from an opening on an underside of the rotating drum in a direction 7 of movements of the residue.

14 Claims, 3 Drawing Sheets

MOISTURIZING EQUIPMENT

BACKGROUND OF THE INVENTION

The invention relates to a moisturizing equipment for moisturizing an object to be moisturized, which object mainly contains a sheet-shaped substance (for example, vinyl sheet).

Conventional moisturizing equipments will be described with reference to FIG. 1.

Installed at a bottom of a vessel 12 is an agitating vane 13 for rotation in a rotating direction 14. A water addition unit 15 is installed on one side of an upper portion of the vessel 12, a supply port 16 for an object is provided on the other side of the upper portion of the vessel 12, and a recovery port 17 for the object is provided on a lower side of the vessel 12.

In such moisturizing equipment, the object is supplied into the vessel 12 from the supply port 16 in a direction 18 of supplying, water is added into the vessel 12 from the water addition unit 15, and the agitating vane 13 is rotated.

Then, the object is moisturized and discharged from the recovery port 17 in a direction 19 of recovery.

Such conventional moisturizing equipments are disadvantageous in that the moisturizing efficiency is extremely decreased when a sheet-shaped substance is contained in an object.

Concretely stated, an object remains within the vessel 12 such that a sheet-shaped substance is twined around the agitating vane 13 and covers the recovery port 17 of the vessel 12, thus resulting in reduction in the processing capacity of the moisturizing equipment. In particular, when an object is to be continuously moisturized in great quantity, it is necessary to efficiently control a series of processes including the process of supplying into the vessel 12 of the object, the moisturizing process, and the recovering process. However, it is possible that the reason for reduction in the processing capacity of the moisturizing equipment, caused by a sheet-shaped substance is generated in the respective processes described above. In particular, when an object is a substance of many kinds, such as a sheet-shaped substance and so on, like waste, it is extremely difficult to enhance the moisturizing efficiency of the whole object. Further, in the case where the moisturizing processing is needed as a preliminary process in recycling and waste disposal, it is not possible to realize suitable recycling and processing.

In this manner, since it is difficult in the conventional moisturizing equipments to moisturize an object, which contains a sheet-shaped substance, it has been earnestly desired to develop a moisturizing equipment capable of operating even under the above-mentioned troublesome conditions.

SUMMARY OF THE INVENTION

It is an object of the invention to provide a moisturizing equipment capable of moisturizing an object to be moisturized, with high efficiency even when the object contains a sheet-shaped substance or the like.

It is another object of the invention to provide a moisturizing equipment, in which an object is prevented from remaining in a vessel.

According to the invention, there is provided a moisturizing equipment having an addition unit for adding a moisturizing medium to an object to moisturize the object, the equipment comprising a hollow rotating drum provided obliquely, and a size classification unit provided on a part of the rotating drum, and wherein the object is supplied from an opening on an upper portion of the rotating drum, so that an object having at most a predetermined size is discharged from the size classification unit while an object having a larger size than the predetermined size is discharged from an opening on an underside of the rotating drum.

DESCRIPTION OF THE PREFERRED EMBODIMENTS

Moisturizing equipments according to two embodiments of the inventions will be described hereinbelow with reference to FIGS. 2 to 5.

Figure 1:
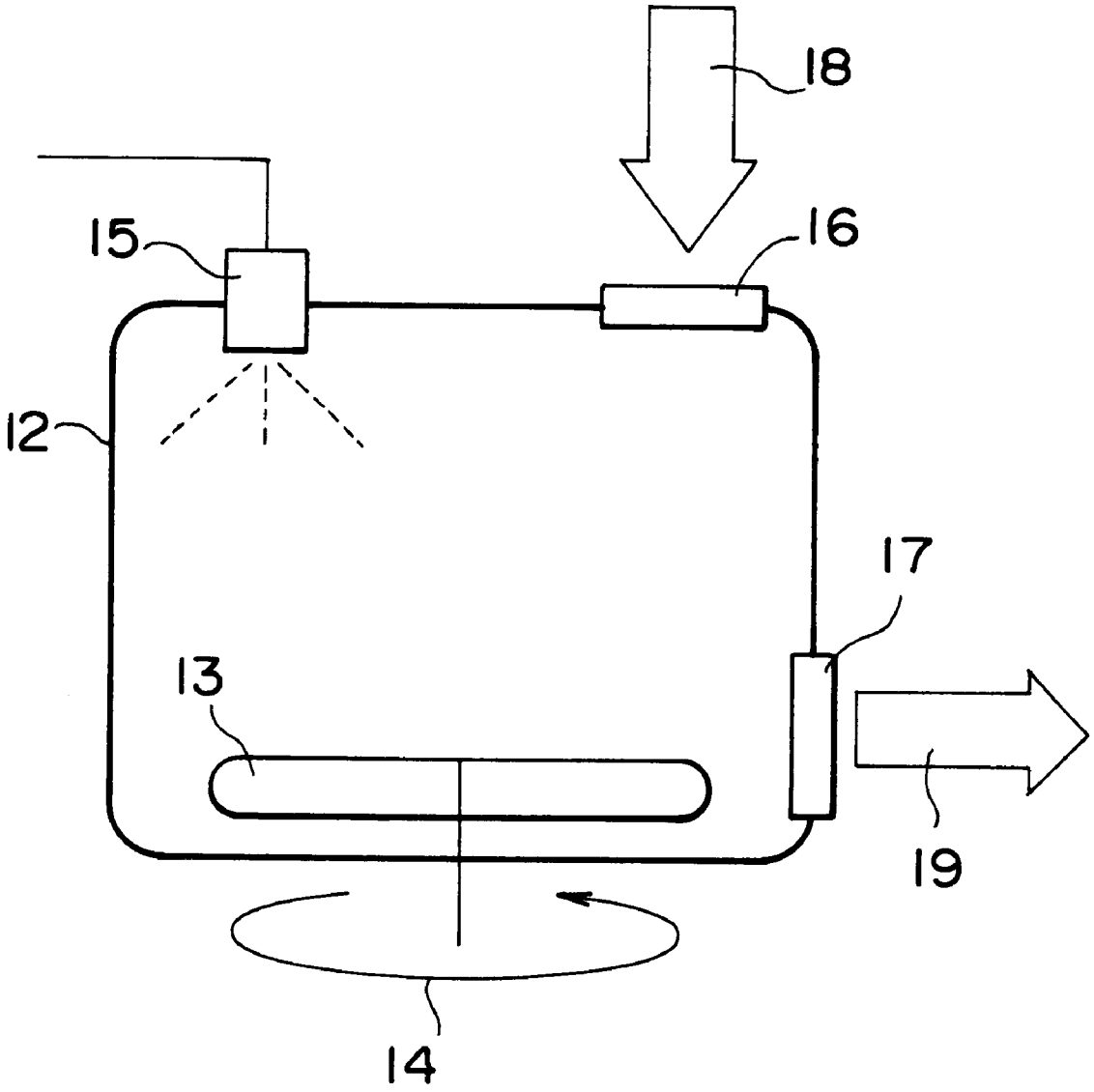
FIG. 1 PRIOR ART
FIG. 1 is a cross sectional view, as viewed from a front side, showing a conventional moisturizing equipment.
Figure 2:
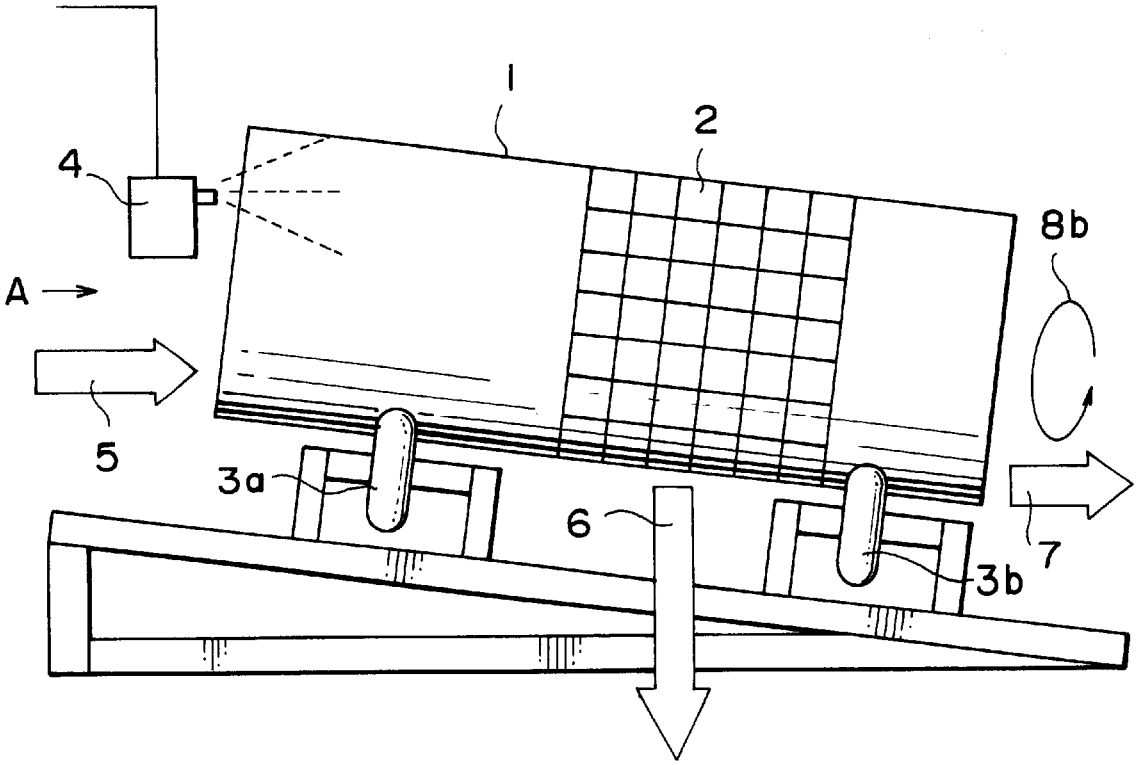
FIG. 2 is a front view showing a moisturizing equipment according to a first embodiment of the invention.
Figure 3:
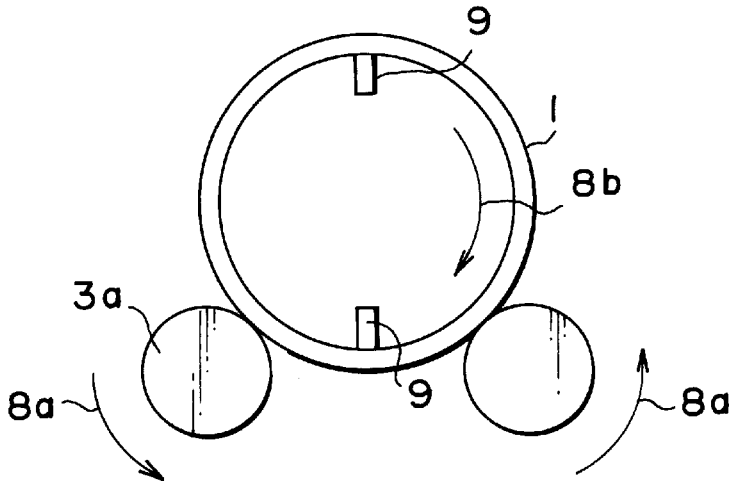
FIG. 3 is a side view, as viewed in a direction A in FIG. 2, showing an essential part.

First, a first embodiment of the invention will be described hereinbelow with reference to FIGS. 2 and 3. FIG. 2 is a front view, and FIG. 3 is a side view showing an essential part as viewed in a direction A in FIG. 2.

In the moisturizing equipment, a hollow rotating drum 1 is supported at its outer peripheral surface by two pairs of rotors 3*a*, 3*b*. The rotating drum 1 is installed obliquely so that its opening on a side where an object to be moisturized is supplied is positioned higher than an opening on the other side. Also, when the two pairs of rotors 3*a*, 3*b* are rotated by a motor (not shown) in a direction 8*a* of rotation, the rotating drum 1 is rotated in a direction 8*b* of rotation. The rotating drum 1 includes a size classification unit 2 disposed toward a lower position side (side in a direction 7 of movements of residue) relative to the vicinity of a center in a lengthwise direction of the drum. The size classification unit 2 is composed of a multiplicity of circular apertures (shown in FIG. 2 as being square apertures for the purpose of convenience), which are provided over 360 degrees on a circumference of the rotating drum 1. A water addition unit 4 is installed in the vicinity of the opening on the side of the rotating drum 1 where an object is supplied. Also, a multiplicity of agitating plates 9 are fixed randomly on an inner peripheral surface of the rotating drum 1.

An example of numerical values of respective parts and units is set such that the rotating drum 1 has a radius of 500 mm and a length of 1500 mm, the opening on the side where an object is supplied is inclined 5 degrees relative to the other opening, and the respective agitating plates 9 have a height of 100 mm, a thickness of 5 mm, and a length of 400 mm. Also, the size classification unit 2 has a width of 400 mm on the side in the direction 7 of movements of residue from the vicinity of the center of the rotating drum 1 in the lengthwise direction, and is provided over 360 degrees on the circumference of the rotating drum 1 with the multiplicity of apertures having a radius of 30 mm. Further, the respective rotors 3*a*, 3*b* have a radius of 150 mm and a width of 50 mm, and the number of revolutions of the respective rotors 3*a*, 3*b* is set so that the number of revolutions of the rotating drum 1 is made 30 rpm. In addition, the water addition unit 4 for addition of mist water is installed above the opening on the side of the rotating drum 1 where an object is supplied.

In the above-mentioned moisturizing equipment, the respective rotors 3*a*, 3*b* rotate in the direction 8*a* of rotation whereby the rotating drum 1 is rotated in the direction 8*b* of rotation. While mist water is added from the water addition unit 4, an object containing a sheet-shaped substance is supplied to the opening of the rotating drum 1 from a supplying direction 5 of the object. Then, the object is moved spirally relative to the inner peripheral surface of the rotating drum 1 while absorbing water (solution) added. At this time, movement of the object is efficiently effected by the respective agitating plates 9. The object being moisturized and having the size equal to or smaller than the predetermined size, i.e. the moisture-processed substance, is classified by the size classification unit 2 to be moved in a direction 6 of the object to be recovered. Meanwhile, an object being moisturized and having the size larger than the predetermined size, i.e. residue, which badly affects the subsequent process is moved in a direction 7 of movements of residue to be recovered from an opening on an underside of the rotating drum 1. When supplied again to the moisturizing equipment through, for example, a breaking process, the residue becomes a moisture-processed substance, and classified by the size classification unit 2 to be moved in the direction 6 of the moisture-processed substance to be recovered.

In this manner, the object is moved spirally within the rotating drum 1 to be moisturized. A moisture-processed substance, having the size equal to or smaller than the predetermined size, is classified by the size classification unit 2 to be continuously discharged. Moreover, the residue, having a size larger than the predetermined size is continuously discharged. Accordingly, the embodiment is clear of such a disadvantage that the object remains in a vessel as in the prior moisturizing equipments.

Figure 4:
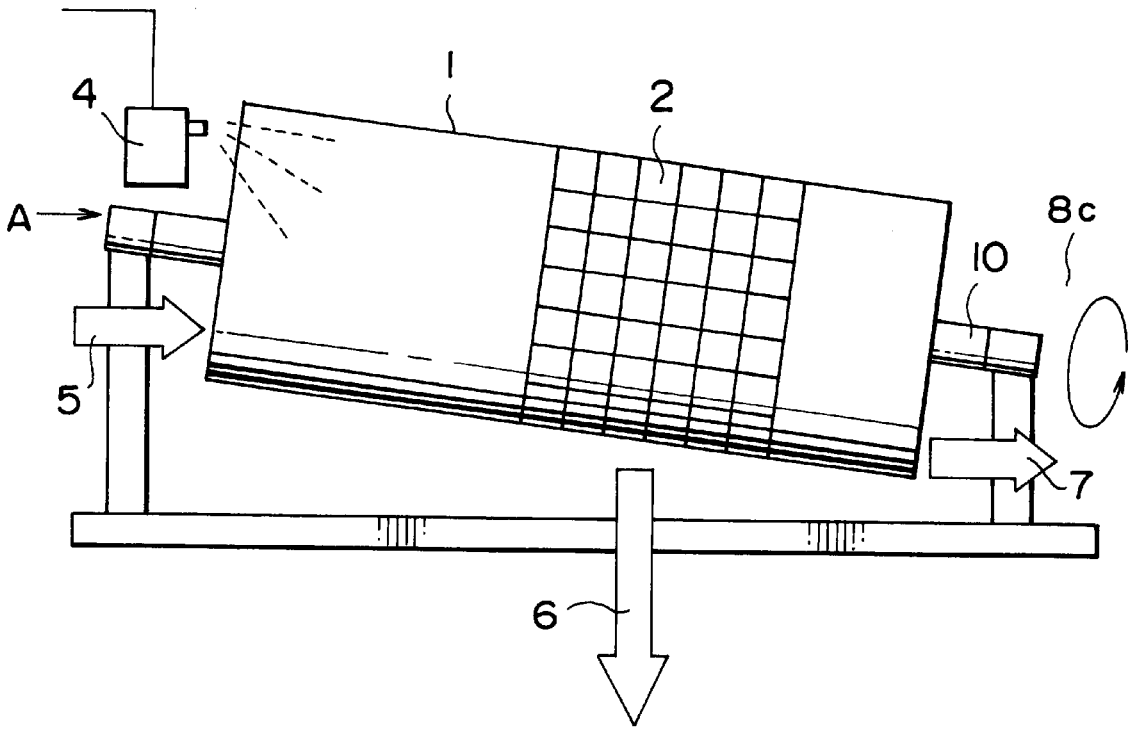
FIG. 4 is a front view showing a moisturizing equipment according to a second embodiment of the invention.
Figure 5:
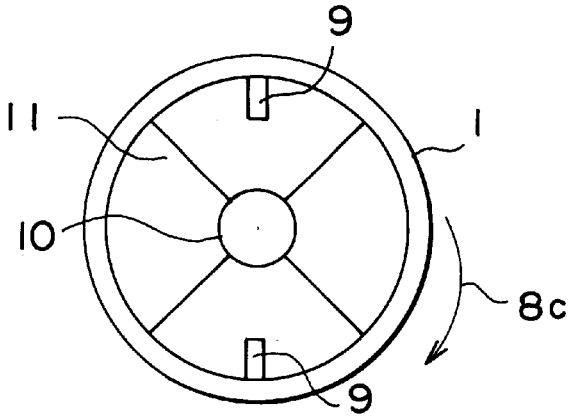
FIG. 5 is a side view, as viewed in a direction A in FIG. 4, showing an essential part.

A second embodiment of the invention will be described hereinbelow with reference to FIGS. 4 and 5. FIG. 4 is a front view, and FIG. 5 is a side view showing an essential part as viewed in a direction A in FIG. 4.

While the rotating drum 1 is supported at its outer peripheral surface by the two pairs of rotors 3*a*, 3*b* in the first embodiment, a rotating drum 1 in the second embodiment is supported by virtue of its inner peripheral surface in the vicinity of its both openings being fixed to four spokes 11, which are fixed to a single rotating shaft 10. The both embodiments are constructionally different in the support construction of the rotating drum 1 but are fundamentally the same in other respects. In the present embodiment, however, several discharge apertures are provided on a circumferential portion somewhat above the opening on a discharge side of the rotating drum 1 so that discharge of residue is not obstructed by the respective spokes 11. A part of residue falls down from the respective discharge apertures to be discharged.

In the moisturizing equipment of the present embodiment, an example of numerical values of respective parts and units is set such that the rotating drum 1 has a radius of 600 mm and a length of 2000 mm, an opening on a side where an object is supplied is inclined 7 degrees relative to an opening on the other side, and respective agitating plates 9 have a height of 80 mm, a thickness of 3 mm, and a length of 300 mm. Also, a size classification unit 2 has a width of 300 mm on a side in a direction 7 of movements of residue from the vicinity of a center of the rotating drum 1 in the lengthwise direction, and is provided over 360 degrees on a circumference of the rotating drum 1 with a multiplicity of apertures having a radius of 30 mm. Further, an example of numerical values of respective parts and units is set such that the rotating shaft 10 has a radius of 75 mm, and the respective spokes 11 has a thickness of 50 mm and is sixteen in number, and the number of revolutions of the rotating drum 1 is made 15 rpm. In addition, a water addition unit 4 for addition of water droplets is installed above the opening on the side of the rotating drum 1 where an object is supplied.

In the above-mentioned moisturizing equipment, the rotating shaft 10 rotates in a direction 8*c* of rotation whereby the rotating drum 1 is rotated in the same direction. While water droplets are added from the water addition unit 4, an object containing a sheet-shaped substance is supplied to the opening of the rotating drum 1 from a supplying direction 5 of the object. Then, the object is moved spirally relative to the inner peripheral surface of the rotating drum 1 while absorbing water (solution) added. At this time, movement of the object is efficiently effected by the respective agitating plates 9. The object, that is, an object being moisturized and processed and having a size equal to or smaller than the predetermined size is classified by the size classification unit 2 to be moved in a direction 6 of the moisture-processed substance to be recovered. Meanwhile, an object, i.e., residue, having a size larger than the predetermined size and adversely affecting the subsequent processes is moved in a direction 7 of movements of residue to be recovered from an opening on an underside of the rotating drum 1. When supplied again to the moisturizing equipment through, for example, a breaking process, the residue becomes a moisture-processed substance and classified by the size classification unit 2 to be moved in the direction 6 of movements of the moisture-processed substance to be recovered.

In this manner, the object is moved spirally within the rotating drum 1 to be moisturized. A moisture-processed substance having the size equal to or smaller than the predetermined size is classified by the size classification unit 2 to be continuously discharged. Also residue, having a larger size than the predetermined size, is continuously discharged. Accordingly, the embodiment is clear of such a disadvantage that an object remains in a vessel as in prior moisturizing equipments.

Preferably, numerical values of respective parts and units of the rotating drum 1 in the first and second embodiments are selected from respective ranges of 200 to 1000 mm with respect to radius, 500 to 3000 mm with respect to length, 3 to 45 degrees with respect to inclination, and 5 to 300 rpm with respect to the number of revolutions. Also, the size classification unit 2 is preferably positioned toward the direction 7 of movements of residue from the vicinity of the center of the rotating drum 1 in the lengthwise direction, and can be constructed to employ circular-shaped holes or mesh provided on the circumference of the rotating drum 1. Preferably, a width of the size classification unit 2 is selected from a range of 100 to 1200 mm, and a size or a radius of the circular-shaped holes or mesh is selected from a range of 10 to 300 mm.

In the first and second embodiments, the water addition unit 4 is installed in the vicinity of the opening on the side where an object is supplied, but may be installed inside the rotating drum 1. Further, it is possible to install the water addition unit 4 in the vicinity of the opening on the side where the residue is discharged. In particular, with the second embodiment, the provision of the water addition unit 4 inside the rotating shaft 10 is effective. Further, it is possible to enhance the moisturizing efficiency by installing several water addition units 4. While an operating measure of the water addition unit 4 includes spraying of mist water, addition of water droplets or blowing of water vapor, or the like, a suitable method is selected taking account of the moisturizing efficiency for an object.

In addition, it is possible to employ an electrolytic water solution, an organic solvent and so on as a moisturizing medium.

Because the respective agitating plates 9 are provided for assisting movements of an object, a moisture-processed substance, and residue, they are designed with respect to shape, size, number, locations of installation, and so on depending upon a kind of an object.

As apparent from the above explanation, according to the invention, an object, containing a sheet-shaped substance is moved spirally within the rotating drum to be moisturized, and an object, having at most a predetermined size is continuously discharged from the size classification unit to be recovered, and a substance (residue) being moisturized, having a larger size than the predetermined size is also continuously discharged from the rotating drum. Accordingly, the invention is clear of such a disadvantage that an object remains in a vessel as in the prior moisturizing equipments. As a result, the invention enables efficiently moisturizing an object, containing a sheet-shaped substance, in particular, a substance, such as waste, being moisturized, in which substances having shapes of many kinds are mixed. Accordingly, the invention is industrially useful since it is effectively applied to appropriate recycling and waste disposal.

What is claimed is:

1. A moisturizing equipment having an addition unit for adding a moisturizing medium to an object to be moisturized to moisturize said object, said moisturizing equipment comprising a hollow rotating drum provided obliquely, and a size classification unit provided on a part of said rotating drum, and wherein said object is supplied from an opening on an upper portion of the rotating drum, so that an object, having at most a predetermined size is discharged from the size classification unit, and an object, having a larger size than the predetermined size is discharged from an opening on an underside of said rotating drum.

2. A moisturizing equipment according to claim 1, wherein said size classification unit is provided downward from a center of said rotating drum in a lengthwise direction thereof.

3. A moisturizing equipment according to claim 1, wherein said size classification unit is provided over 360 degrees on a circumstance of said rotating drum.

4. A moisturizing equipment according to claim 1, wherein said rotating drum is rotated by plural pairs of rollers, which support an outer peripheral surface of said rotating drum.

5. A moisturizing equipment according to claim 1, wherein said rotating drum is fixed to a plurality of spokes fixed to a single rotating shaft, which extends through said rotating drum.

6. A moisturizing equipment according to claim 1, wherein the size classification unit is composed of mesh.

7. A moisturizing equipment according to claim 1, wherein said size classification unit is composed of a plurality of apertures, which are formed on a circumstance of said rotating drum.

8. A moisturizing equipment according to claim 1, wherein said rotating drum is provided at an inner peripheral surface thereof with a plurality of agitating plates for agitating said object to be moisturized.

9. A moisturizing equipment according to claim 1, wherein said addition unit functions to make a solution misty.

10. A moisturizing equipment according to claim 1, wherein said addition unit functions to convert a solution into vapor.

11. A moisturizing equipment according to claim 1, wherein said addition unit is installed inside said rotating drum.

12. A moisturizing equipment according to claim 1, wherein said moisturizing medium is water.

13. A moisturizing equipment according to claim 1, wherein said moisturizing medium is an electrolytic water solution.

14. A moisturizing equipment according to claim 1, wherein said moisturizing medium is an organic solvent.

* * * * *